US008049130B2

(12) United States Patent
Kobayashi et al.

(10) Patent No.: US 8,049,130 B2
(45) Date of Patent: Nov. 1, 2011

(54) VACUUM INSULATED SWITCH AND VACUUM INSULATED SWITCHGEAR

(75) Inventors: Masato Kobayashi, Hitachi (JP); Kenji Tsuchiya, Hitachi (JP); Miki Yamazaki, Kashiwa (JP); Ayumu Morita, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 603 days.

(21) Appl. No.: 12/174,164

(22) Filed: Jul. 16, 2008

(65) Prior Publication Data

US 2009/0032500 A1 Feb. 5, 2009

(30) Foreign Application Priority Data

Jul. 30, 2007 (JP) ..... 2007-197507

(51) Int. Cl.
*H01H 33/66* (2006.01)

(52) U.S. Cl. ..... 218/140; 218/154

(58) Field of Classification Search ..... 218/10, 218/12, 14, 118, 139, 140, 153–155
See application file for complete search history.

(56) References Cited

U.S. PATENT DOCUMENTS

| | | | | |
|---|---|---|---|---|
| 3,562,574 A | | 2/1971 | Wesoloski | |
| 3,920,941 A | | 11/1975 | Hundstad | |
| 5,251,659 A | * | 10/1993 | Sturman et al. | 335/281 |
| 5,685,214 A | * | 11/1997 | Neff et al. | 92/31 |

FOREIGN PATENT DOCUMENTS

| | | | |
|---|---|---|---|
| DE | 3026197 | A1 | 2/1982 |
| DE | 3803065 | A1 | 8/1989 |
| EP | 1 251 539 | A1 | 10/2002 |
| GB | 2 080 035 | A | 1/1982 |
| JP | 2006-238522 | | 9/2006 |
| JP | 2007-014086 | | 1/2007 |

OTHER PUBLICATIONS

The Intellectual Property Office of People's Republic of China, The First Office Action, Application No. 2008-10128081.8, Nov. 24, 2010, 11 pp., China.

* cited by examiner

*Primary Examiner* — Renee S Luebke
*Assistant Examiner* — Marina Fishman
(74) *Attorney, Agent, or Firm* — Mattingly & Malur, PC

(57) ABSTRACT

The vacuum insulated switch includes a vacuum container; two stationary contacts contained in the vacuum container; two movable contacts contained in the vacuum container, each capable of contacting and separating from a corresponding one of the stationary contacts; a vacuum insulated actuating rod connected to the two movable contacts; an operating rod connected to the vacuum insulated actuating rod via a metal bellows; and a guide for guiding the operating rod. The vacuum insulated switch has an off-axis displacement allowing structure which is provided between the guide and the operating rod for allowing the off-axis displacement of the operating rod.

5 Claims, 4 Drawing Sheets

VACUUM INSULATED SWITCH AND VACUUM INSULATED SWITCHGEAR

CLAIM OF PRIORITY

The present application claims priority from Japanese patent application serial No. 2007-197507, filed on Jul. 30, 2007, the content of which is hereby incorporated by reference into this application.

BACKGROUND OF THE INVENTION

1. Field of the Invention

The present invention relates to a vacuum insulated switch and a vacuum insulated switchgear, and particularly to a double-break three-position vacuum insulated switch having circuit breaker and disconnector functions and a vacuum insulated switchgear using such a switch.

2. Description of Related Art

Today, in the field of power receiving and transforming systems, user needs are diversified. Each user system uses a different load type and operating condition depending on the application, and each local electricity distribution system is designed by considering the safety, reliability, maintenance and future load requirement. There also need to be considered devices for controlling the breaker, disconnector, and grounding switch of the power receiving and transforming system, as well as devices for monitoring and measuring the system parameters such as voltage, current and power.

An important consideration in such design is how to minimize the space required for installation of the above-cited various devices and how to reduce the installation cost. A solution to this problem is a double-break three-position vacuum switch (e.g., JP2007-14086A).

This double-break three-position vacuum switch contains: in a vacuum container therein having insulating cylinders, two stationary contacts; and two movable contacts capable of contacting and separating from the respective stationary contacts, thereby providing a double-break configuration. The two movable contacts are connected by a movable conductor, which is further connected to a vacuum insulated actuating rod. The vacuum insulated actuating rod extends outside the vacuum container via a metal bellows and is then connected to an operating rod guided by a guide. The operating rod is further connected to an operating lever, which is operated by an operating device. A rotary motion of the operating lever caused by the operating device is converted to a linear motion of the operating rod and vacuum insulated actuating rod. And the movable contacts can be held at three different positions: a closed position to permit current flow; an open position to interrupt current flow; and a disconnect position to ensure the safety of inspection personnel against a surge voltage such as lightning.

Patent document 1: Japanese Patent Application Laid-open No. 2007-14086 (paragraphs 0024-0030 and FIG. 5).

SUMMARY OF THE INVENTION

The above-mentioned double-break three-position vacuum switch is configured so that the operating rod is reciprocatably supported by the guide disposed near the metal bellows in order to equalize the contact forces applied to the two breaker contacts (the two pairs of movable contacts and stationary contacts).

However, a difference between the two contact forces can occur caused by a structural asymmetry due to component variation, assembly error, etc. Such a contact force difference can cause an excessive contact force to be applied to one of the breaker contacts and can also cause the operating rod to contact the guide. In particular, the operating rod can contact the guide locally, so a large operating force is required in order to overcome such a local contact force. This may incur increase in size of the operating device.

Under these circumstances, the present invention is originated to solve the above problem. An object of the present invention is to provide a double-break three-position vacuum insulated switch and/or a vacuum insulated switchgear using the switch, which has circuit breaker and disconnector functions and can equalize the contact forces applied to the two pairs of movable contacts and stationary contacts by preventing even local contact of the operating rod with the guide member.

In order to achieve the above object, a first aspect of the present invention provides a vacuum insulated switch, which includes: a vacuum container; two stationary contacts contained in the vacuum container; two movable contacts contained in the vacuum container, each capable of contacting and separating from a corresponding one of the stationary contacts; a vacuum insulated actuating rod connected to the two movable contacts; an operating rod connected to the vacuum insulated actuating rod via a metal bellows; and a guide for guiding the operating rod; characterized in that, an off-axis displacement allowing structure is provided between the guide and the operating rod and for allowing the off-axis displacement of the operating rod.

In the above first aspect of the present invention, the off-axis displacement allowing structure includes a reduced diameter portion formed on an outer surface of the operating rod, which is facing to an inner surface of the guide so as to create a gap between the operating rod and the guide.

In addition to the above-described reduced diameter portion, the off-axis displacement allowing structure further includes an enlarged diameter portion formed on the outer surface of the operating rod adjacent to the reduced diameter portion, which is facing to the inner surface of the guide so as to slidably contact with the guide when the movable contacts are at open and disconnect positions.

In the above first aspect of the present invention, the off-axis displacement allowing structure further includes: a guide holder for supporting the guide; and an elastic member disposed between an inner surface of the guide holder and an outer surface of the guide, whereby the operating rod slidably contacts the inner surface of the guide.

In the above first aspect of the present invention, the off-axis displacement allowing structure further includes: two opposing guiding members provided on the guide and slidably contacting opposite outer surfaces of the operating rod; a guide holder for supporting the guide having the guiding members; and a pair of elastic members each disposed between an inner surface of the guide holder and an outer surface of the guiding members, respectively.

In the above first aspect of the present invention, the off-axis displacement allowing structure has a gap formed between an inner surface of the guide and an outer surface of the operation rod for allowing the off-axis displacement of the operating rod when the movable contacts contact the stationary contacts.

In the above first aspect of the present invention, the off-axis displacement allowing structure further includes: a guide holder for supporting the guide, a groove formed on an inner surface of the guide, and an elastic member disposed in the groove for contacting an outer surface of the operating rod, whereby the operating rod slidably contacts the elastic member.

A second aspect of the present invention provides a vacuum insulated switchgear, which includes the vacuum insulated switch according to the first aspect of the present invention.

The present invention provides a double-break three-position vacuum insulated switch and/or a vacuum insulated switchgear using the switch, which has circuit breaker and disconnector functions and can equalize the contact forces applied to the two pairs of movable contacts and stationary contacts by preventing even local contact of the operating rod with the guide member. Thus, a switch and/or a switchgear using the switch according to the present invention can suppress increase in size of the operating device as well as provide improved current-carrying properties and increased reliability.

DETAILED DESCRIPTION OF THE PREFERRED EMBODIMENTS

A vacuum insulated switch according to an embodiment of the present invention will be described below with reference to the accompanying drawings.

Figure 1:
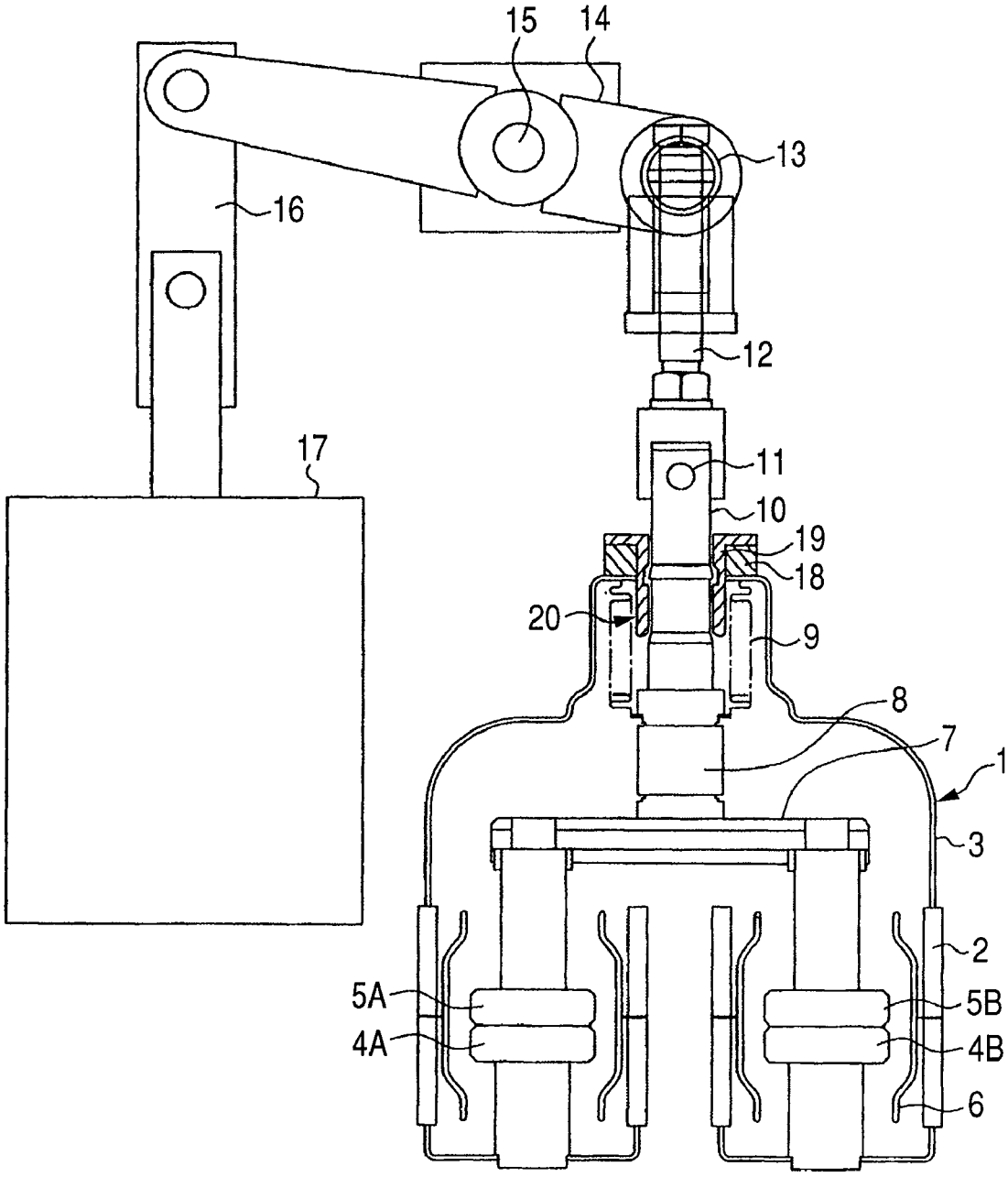
FIG. 1 is a longitudinal sectional view of a vacuum insulated switch to illustrate an embodiment of the present invention.
Figure 2:
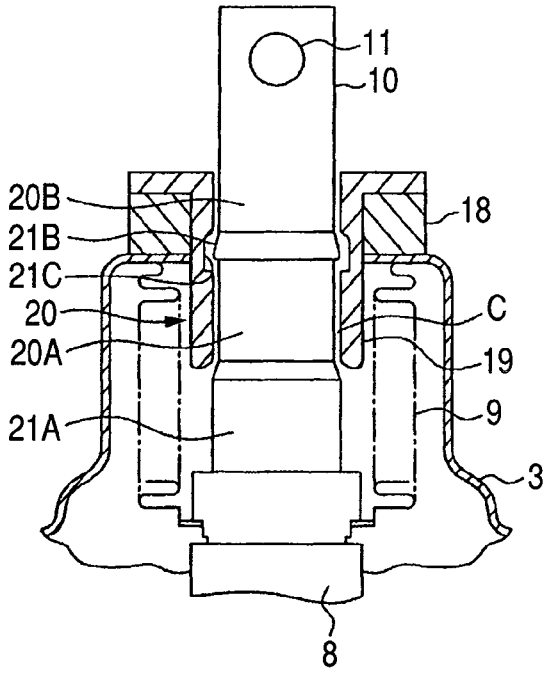
FIG. 2 is an enlarged cross sectional view illustrating an off-axis displacement allowing structure of the air insulated operating rod for use in the vacuum insulated switch shown in FIG. 1.

FIG. 1 is a longitudinal sectional view of a vacuum insulated switch to illustrate a first embodiment of the present invention. FIG. 2 is an enlarged cross sectional view illustrating an off-axis displacement allowing structure of the operating rod for use in the vacuum insulated switch shown in FIG. 1.

A double-break three-position vacuum insulated switch 1 shown in FIG. 1 includes: a vacuum container 3 which keeps a vacuum therein, and the vacuum container 3 is provided with insulating cylinders 2; and, contained in the vacuum container 3, there are two stationary contacts 4A and 4B and corresponding two movable contacts 5A and 5B, each capable of contacting and separating from a corresponding one of the stationary contacts, thereby providing a double-break configuration.

When used, for example, in a feeder panel, the stationary contact 4A on the left in FIG. 1 is connected to a bus bar (not shown), while the stationary contact 4B on the right in FIG. 1 is connected to a cable head (not shown) via a feeder. In addition, the contacts 4A and 5A and their surroundings are covered by an arc shield 6, and also the contacts 4B and 5B and their surroundings are covered by another arc shield 6 provided in the vacuum container 3.

The movable contacts 5A and 5B are connected by a movable conductor 7 which is reinforced with a metal (such as stainless steel) receiving no high temperature annealing. A vacuum insulated actuating rod 8 is connected to the movable conductor 7. The vacuum insulated actuating rod 8 extends outside the container 3 via a metal bellows 9 provided at the top opening of the vacuum container 3, and is then connected to an operating rod 10. To the operating rod 10 is connected one end of a connecting rod 12 by a pin 11.

To the other end of the connecting rod 12, there is connected one end of an operating lever 14 by a pin 13. A middle portion of the operating lever 14 is rotatably mounted on a fixed shaft 15. The other end of the operating lever 14 is connected via a connecting rod 16 to an operating mechanism 17 such as an electromagnet.

Rotating the operating lever 14 by the operating mechanism 17 allows vertical movement of the movable contacts 5A and 5B. And the movable contacts can be held at three different positions: a closed position (i.e., that shown in FIG. 1) to permit current flow; an open position above the closed position to interrupt current flow; and a disconnect position further above the open position to ensure the safety of inspection personnel against a surge voltage such as lightning.

A guide holder 18 is provided on and around the top opening of the vacuum container 3. In the guide holder 18, there is provided a guide 19 for guiding the operating rod 10. There can occur an imbalance in the mechanical structure for operating the operating rod 10 due to component variation, assembly error, etc. In such a case, mere on-axis movement of the operating rod 10 may not exert equal contact forces on the two breaker contacts. In order to address this problem, between the guide 19 and operating rod 10, there is provided an off-axis displacement allowing structure 20 for allowing tilting or off-axis displacement (lateral displacement as viewed in FIG. 1) of the operating rod 10 when the movable contacts 5A and 5B are caused to contact the stationary contacts 4A and 4B.

As shown in FIG. 2 in detail, the off-axis displacement allowing structure 20 includes lower and upper reduced diameter portions 20A and 20B formed on the operating rod 10 so as to form gaps C between the reduced diameter portions 20A and 20B and internal surface of the guide 19, thereby allowing off-axis displacement of the rod 10 when the movable contacts 5A and 5B are moved to the closed position.

In this embodiment, the object of the present invention can be achieved by providing the above-mentioned lower and upper reduced diameter portions 20A and 20B formed on the operating rod 10. However, preferably, under the lower reduced diameter portion 20A of the operating rod 10 is provided a lower enlarged diameter portion 21A adjacent to the lower reduced diameter portion 20A slidably contacting the inner surface of the guide 19, and also between the lower and upper reduced diameter portions 20A and 20B is provided an upper enlarged diameter portion 21B adjacent to the lower reduced diameter portions 20A, 20B. Such a structure enables the movable contacts 5A and 5B to be immovably held at the open and disconnect positions by causing the operating rod 10 to slidably contact the inner surface of the guide 19.

In addition, this embodiment provides a circumferential groove 21C along the inner surface of the guide 19 in order to prevent interference between the upper enlarged diameter portion 21B and the inner surface of the guide 19 when the operating rod 10 tilts.

Next, the operation of the vacuum insulated switch according to this embodiment of the present invention will be described with reference to FIGS. 1 to 4.

Figure 3:
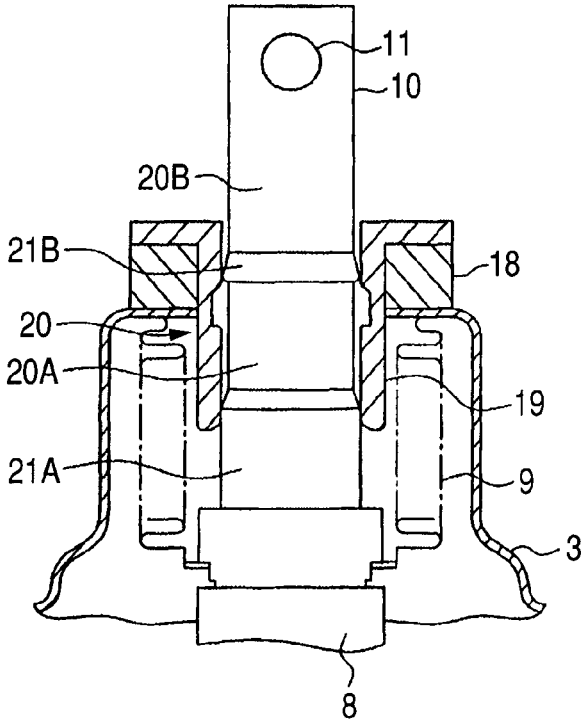
FIG. 3 is an enlarged cross sectional view of the off-axis displacement allowing structure in the vacuum insulated switch shown in FIG. 1 at the open position.
Figure 4:
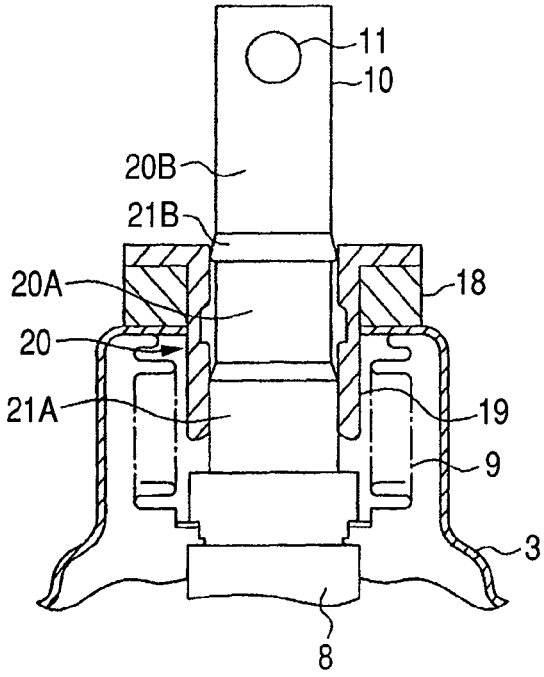
FIG. 4 is an enlarged cross sectional view illustrating the off-axis displacement allowing structure of the vacuum insulated switch shown in FIG. 1 at the disconnect position.

FIG. 3 is an enlarged cross sectional view of the off-axis displacement allowing structure in the vacuum insulated switch shown in FIG. 1 to illustrate how the off-axis displacement allowing structure operates at the open position. FIG. 4 is an enlarged cross sectional view of the off-axis displacement allowing structure in the vacuum insulated switch shown in FIG. 1 to illustrate how the off-axis displacement allowing structure operates at the disconnect position.

At the open position (FIG. 3) and the disconnect position (FIG. 4), the lower and upper enlarged diameter portions 21A and 21B of the operating rod 10 slidably contact the inner surface of the guide 19, thereby preventing radial displacement of the operating rod 10 in the guide 19.

When the movable contacts 5A and 5B are moved from the open position or the disconnect position to the closed position in order to bring the movable contacts 5A and 5B in contact with the stationary contacts 4A and 4B, the operating rod 10 moves downwardly (as viewed in FIG. 1) and then, the gaps C are formed between the lower and upper reduced diameter portions 20A and 20B and the inner surface of the guide 19.

Such formation of the gaps C prevents the outer surface of the operating rod 10 from even partially contacting the inner surface of the guide 19 even if the operating rod 10 tilts (tilting to left or right as viewed in FIG. 1) from the axis of the guide 19 when it is moves down caused by a structural imbalance due to component variation, assembly error, etc. In other words, this allows the off-axis displacement of the operating rod 10.

Allowing such off-axis displacement of the operating rod 10 can equalize the contact forces applied to the movable contacts 5A, 5B for contacting the stationary contacts 4A, 4B, respectively.

This embodiment can prevent even local contact of the operating rod 10 with the inner surface of the guide 19 caused by the off-axis movement thereof, and as a result no unbalanced load is applied to the guide 19 or the vacuum container 3 sustaining the guide 19. Therefore, there is no need for additional strength reinforcement of such members.

In addition, the contact forces applied to the movable contacts 5A, 5B for contacting the stationary contacts 4A, 4B can be equalized; thus, for example, electrode degradation due to increased resistance or contact failure can be reduced, leading to improved reliability.

Figure 5:
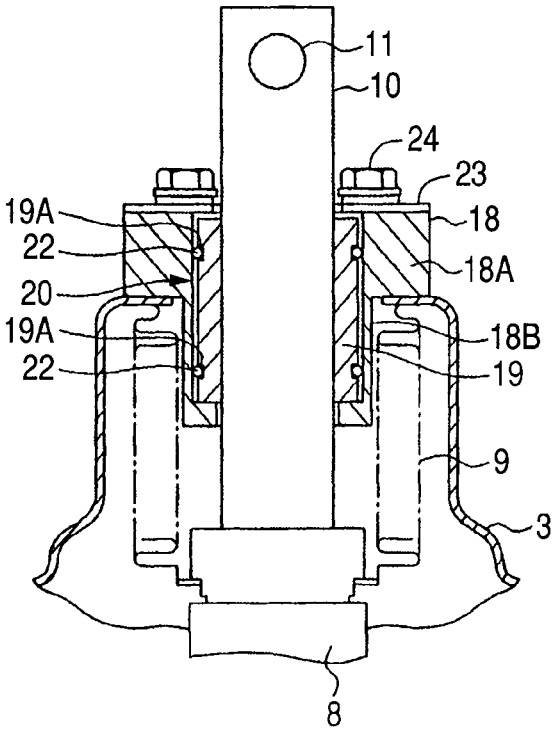
FIG. 5 is an enlarged cross sectional view illustrating an off-axis displacement allowing structure of the operating rod for use in a vacuum insulated switch according to another embodiment of the present invention.

FIG. 5 is an enlarged cross sectional view illustrating an off-axis displacement allowing structure of the operating rod for use in a vacuum insulated switch according to a second embodiment of the present invention, in which elements designated by the same reference numerals as those used in FIGS. 1 and 2 represent the same or equivalent elements.

In the off-axis displacement allowing structure 20 of the operating rod 10 according to this embodiment, the guide holder 18 includes: a flange 18A for fixing the guide holder 18 to the vacuum container 3; and a guide supporting cylinder 18B integrally formed with the flange 18A. A cylindrical guide 19 for guiding the operating rod 10 is provided between the inner surface of the guide supporting cylinder 18B and outer surface of the air insulated operating rod 10. The cylindrical guide 19 is provided with two guide members 19 opposing each other and forming one cylindrical guide. Along upper and lower portions of the outer surface of the cylindrical guide 19, there are formed grooves 19A and 19A, in each of which an annular elastic member 22 such as a rubber ring is inserted. A cap 23 is fixed to the upper surface of the flange 18A of the guide holder 18 by bolts 24.

In this embodiment, the annular elastic members 22 allow the cylindrical guide 19 to tilt in the guide supporting cylinder 18B, thereby preventing the outer surface of the operating rod 10 from even locally contacting the inner surface of the cylindrical guide 19 even if the operating rod 10 tilts from the axis of the cylindrical guide 19 when it is moved down. In other words, this allows the off-axis displacement of the operating rod 10. Allowing such off-axis displacement of the operating rod 10 enables equalization of the contact forces applied to the movable contacts 5A, 5B for contacting the stationary contacts 4A, 4B, respectively.

Figure 6:
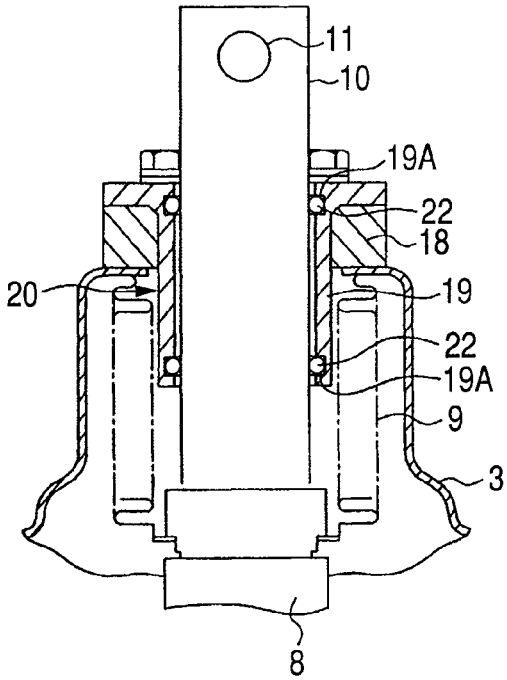
FIG. 6 is an enlarged cross sectional view illustrating an off-axis displacement allowing structure of the operating rod for use in a vacuum insulated switch according to still another embodiment of the present invention.

FIG. 6 is an enlarged cross sectional view illustrating an off-axis displacement allowing structure for use in a vacuum insulated switch according to a third embodiment of the present invention, in which elements designated by the same reference numerals as those used in FIGS. 1, 2 and 5 represent the same or equivalent elements.

In the off-axis displacement allowing structure 20 of the operating rod 10 according to this embodiment, along upper and lower portions of the inner surface of a guide 19 are formed grooves 19A and 19A, in each of which an annular elastic member 22 such as a rubber ring is inserted so as to contact the outer surface of the operating rod 10.

Similarly to the above-described embodiments, this embodiment also allows the off-axis displacement of the operating rod 10 by the deformation of the annular elastic members 22. And, allowing such off-axis displacement of the operating rod 10 enables equalization of the contact forces applied to the movable contacts 5A, 5B for contacting the stationary contacts 4A, 4B, respectively.

Figure 7:
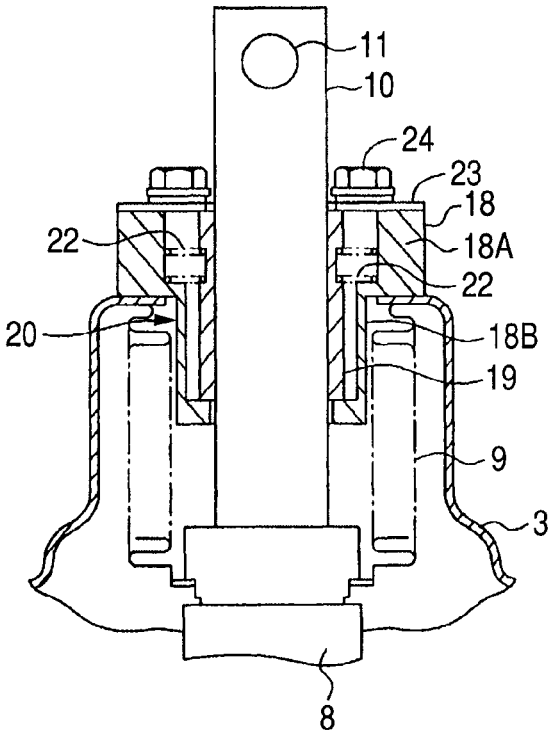
FIG. 7 is an enlarged cross sectional view illustrating an off-axis displacement allowing structure of the operating rod for use in a vacuum insulated switch according to yet another embodiment of the present invention.

FIG. 7 is an enlarged cross sectional view illustrating an off-axis displacement allowing structure of the operating rod for use in a vacuum insulated switch according to a fourth embodiment of the present invention, in which also elements designated by the same reference numerals as those used in FIGS. 1, 2 and 5 represent the same or equivalent elements.

In the off-axis displacement allowing structure 20 according to this embodiment, a cylindrical guide 19 is provided in a guide-supporting cylinder 18B of a guide holder 18. And, two opposing springs 22 and 22 are provided between opposite outer surfaces of the guide 19 and inner surfaces of the cylinder 18B so that the operating rod 10 slidably contacts the inner surface of the guide 19.

In this embodiment, similarly to the second embodiment, the guide 19 can tilt, thereby allowing the off-axis displacement of the operating rod 10. And, allowing such off-axis displacement of the operating rod 10 enables equalization of contact forces applied to the movable contacts 5A, 5B for contacting the stationary contacts 4A, 4B, respectively.

In this embodiment, the operating rod 10 and guide 19 both have a circular cross section. However, in order to prevent rotation of the guide 19 around the operating rod 10 caused by an external force, on opposite sides of the rod 10 (the right and left sides of FIG. 7) there may be provided two opposing flat surfaces perpendicular to the drawing plane and also two flat surfaces may be provided on opposite inner surfaces of the guide 19 so as to be parallel to and contact the flat surfaces of the operating rod 10. This configuration can prevent rotation of the guide 19 around the operating rod 10, thus preventing removal and deformation of the springs 22 as well as twisting of the metal bellows 9.

Although the above embodiments dispose the movable contacts 5A and 5B above the stationary contacts 4A and 4B, the present invention can also be applied to the case where the movable contacts 5A and 5B are disposed below the stationary contacts 4A and 4B.

In addition, although the above embodiments have been described for a vacuum insulated switch, the present invention can also be applied to a vacuum insulated switchgear which, within a casing, contains a vacuum insulated switch 1 and other devices for ensuring safety of personnel during maintenance and inspection work, such as a disconnector, grounding switch, detector for measuring the voltages and currents of the system, and protective relay.

What is claimed is:

1. A vacuum insulated switch, comprising:

a vacuum container;

two stationary contacts contained in the vacuum container;

two movable contacts contained in the vacuum container, each capable of contacting and separating from a corresponding one of the stationary contacts;

a vacuum insulated actuating rod connected to the two movable contacts;

an operating rod connected to the vacuum insulated actuating rod via a metal bellows;

a guide for guiding the operating rod; and an off-axis displacement allowing structure which is provided between the guide and the operating rod to allow the off-axis displacement of the operating rod, wherein, when the moveable contacts contact the stationary contacts, the off-axis displacement allowing structure is positioned to allow an off-axis displacement of the operating rod, and wherein, when the movable contacts are at an open position and a disconnect position, the off-axis displacement allowing structure is positioned to prevent a radial displacement of the operating rod.

2. The vacuum insulated switch according to claim 1, wherein the off-axis displacement allowing structure includes a reduced diameter portion formed on an outer surface of the operating rod, which is facing toward an inner surface of the guide, so as to create a gap between the operating rod and the guide.

3. The vacuum insulated switch according to claim 2, wherein the off-axis displacement allowing structure further includes an enlarged diameter portion formed on the outer surface of the operating rod adjacent to the reduced diameter portion, which faces the inner surface of the guide so as to slidably contact with the guide when the movable contacts are at open and disconnect positions.

4. The vacuum insulated switch according to claim 1, wherein the off-axis displacement allowing structure is provided with a gap formed between an inner surface of the guide and an outer surface of the operation rod to allow the off-axis displacement of the operating rod when the movable contacts contact the stationary contacts.

5. A vacuum insulated switchgear, comprising the vacuum insulated switch of claim 1.

* * * * *